US007398791B2

(12) United States Patent
Tucker

(10) Patent No.: US 7,398,791 B2
(45) Date of Patent: Jul. 15, 2008

(54) WALKING AID DEVICE AND METHOD OF USING SAME

(76) Inventor: Michael Tucker, 908 Pebblebrook Dr., Raleigh, NC (US) 27609

( * ) Notice: Subject to any disclaimer, the term of this patent is extended or adjusted under 35 U.S.C. 154(b) by 311 days.

(21) Appl. No.: 11/118,705

(22) Filed: Apr. 29, 2005

(65) Prior Publication Data

US 2006/0254634 A1 Nov. 16, 2006

(51) Int. Cl.
*A45B 9/00* (2006.01)
*A45B 9/04* (2006.01)
*A45B 3/00* (2006.01)

(52) U.S. Cl. ..... 135/66; 135/65; 135/77; 135/84

(58) Field of Classification Search ..... 135/65, 135/66, 84, 910
See application file for complete search history.

(56) References Cited

U.S. PATENT DOCUMENTS 6,055,997 A * 5/2000 Greenstadt et al. ..... 135/65
6,330,888 B1 * 12/2001 Aravantinos et al. ..... 135/66
6,378,540 B2 * 4/2002 Iwasa ..... 135/65

FOREIGN PATENT DOCUMENTS

DE 4316284 A1 * 11/1994

OTHER PUBLICATIONS

Laser Cane advertisement from www.upstep.com; pp. 1 and 2, Instep Mobility Products Corp.

* cited by examiner

*Primary Examiner*—David R Dunn
*Assistant Examiner*—Danielle N Jackson
(74) *Attorney, Agent, or Firm*—Triangle Patents, PLLC

(57) ABSTRACT

A walking aid device for assisting a user to walk by presenting a true 3-D obstacle that is automatically activated during normal use of a cane or walking support, to which the device is attached proximal to the floor end, and during use when in an extended position is non-parallel to the floor surface, is perceived by the user to be an obstacle over which the foot on the same side of the user's body must step. A method of use providing for attaching the device to the cane or walking support and using it in a cycle that produces a walking-type motion for the user.

17 Claims, 5 Drawing Sheets

WALKING AID DEVICE AND METHOD OF USING SAME

BACKGROUND OF THE INVENTION (1) Field of the Invention

The present invention relates generally to walking assistance devices and, more particularly, to a device to aid walking for persons having Parkinson's disease.

(2) Description of the Prior Art

Typically, prior art walking supports having additional features or components to aid a user having Parkinson's disease include an extended rod or light beam, usually attached to a cane. However, neither the light beams or the extended rods, which are generally parallel to the floor surface, present a true 3-D obstacle to the user, and are not always effective to stimulate the brain to perceive an obstacle and therefore promote a walking/stepping motion. Thus, there remains a need for a true 3-D obstacle to be presented by a device that is removably connectable to a cane and having properties of automatically extending between a first and second, extended position to ensure that the user does not stumble over it.

SUMMARY OF THE INVENTION

The present invention is directed to a walking aid device for use with a cane or walking support leg to provide a true 3-D visual cue to assist persons having Parkinson's disease by providing a retractable, distinct obstacle over which a foot must step.

Preferably, the walking aid device for assisting a user to walk by presenting a true 3-D obstacle that is automatically activated during normal use of a cane or walking support, to which the device is attached proximal to the floor end, and during use when in an extended position is non-parallel to the floor surface, is perceived by the user to be an obstacle over which the foot on the same side of the user's body must step. A method of use provides for attaching the device to the cane or walking support and using it in a cycle that produces a walking-type motion for the user.

The present invention is further directed to a method for using the walking aid device with a cane or walking support leg to provide a true 3-D visual cue to assist persons having Parkinson's disease by providing a retractable, distinct obstacle over which a foot must step.

Thus, the present invention provides a walking aid device for use with a cane or a walking support structure (usually one leg only) and a method for using the same in a cycle wherein one foot must step over the device when it is automatically extended in front of the user's foot on the same side of the body, when the cane is lifted, the device automatically retracts from its extended position, the user slides the second foot forward and repeat.

Accordingly, one aspect of the present invention is to provide a walking aid device to assist a user having Parkinson's disease, the device further including: a body element attachable to a walking support; a plunger device; a visual cue component that provides a physical barrier when in an extended position, and that stands out away from a floor surface when extended to maximize the distinction from the surface; translation means for moving the visual cue component between a first position and a second position that is extended from the body element; wherein the translation means are disposed within the body and connected with the plunger device and the visual cue component such that the visual cue component is automatically moved between the first and second positions when a user applies weight to the walking support when the device is attached thereto and activates the plunger device against the floor surface; thereby providing a physical obstacle over which the user must step to move forward in a walking-type motion.

Another aspect of the present invention is to provide the walking aid device attached to a walking support, such as a cane or walker.

Still another aspect of the present invention is to provide a method of using the walking aid device for a user to move forward with a walking-type motion using the actual 3-D visual cue of the device when activated against a walking surface.

These and other aspects of the present invention will become apparent to those skilled in the art after a reading of the following description of the preferred embodiment when considered with the drawings.

BRIEF DESCRIPTION OF THE DRAWINGS

FIG. 3C shows a perspective view of the pivot gear component detached from the device.

DETAILED DESCRIPTION OF THE PREFERRED EMBODIMENTS

Figure 1C:
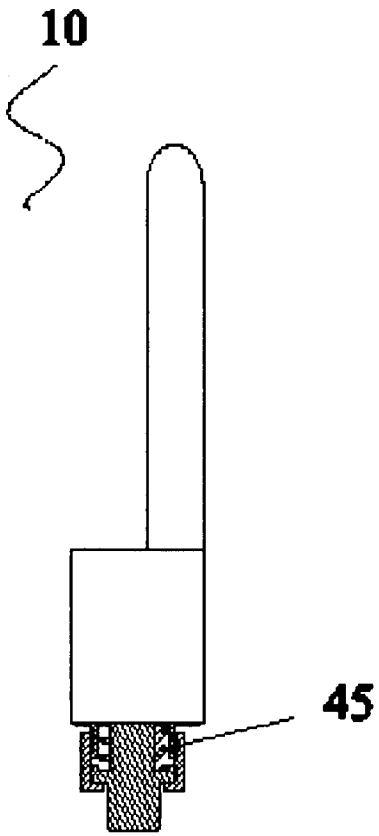
FIG. 1C is a side or front view of the device shown in FIG. 1A, in a non-activated or raised position.

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms.

Figure 1A:
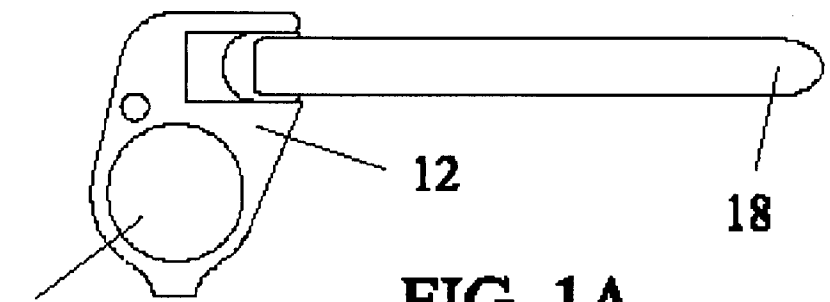
FIG. 1A is a top view of a walking aid device constructed according to the present invention.
Figure 1B:
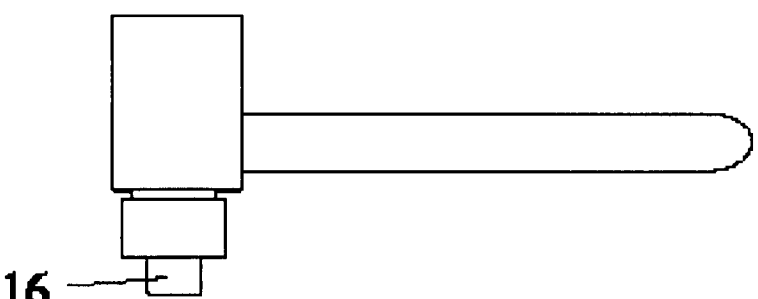
FIG. 1B is a side or front view of the device shown in FIG. 1A, in an activated or lowered position.
Figure 1D:
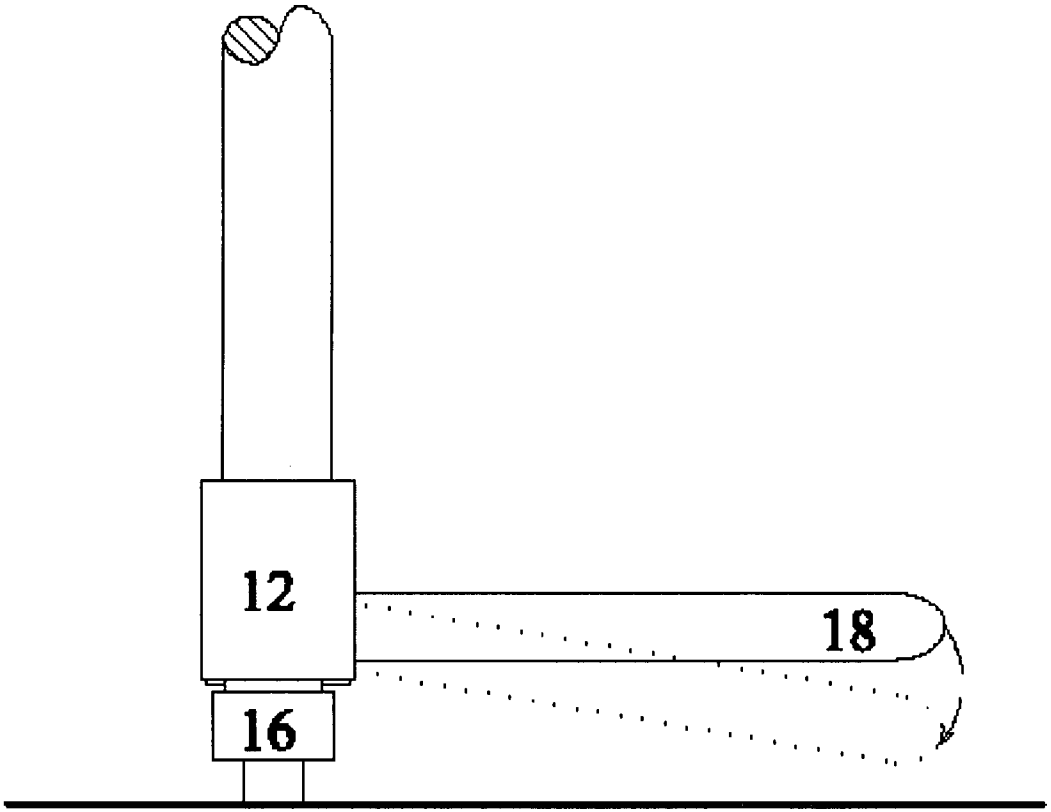
FIG. 1D is a side view of the device shown in an activated or lowered position in use, wherein the tip of the visual cue touches the floor surface.
Figure 2B:
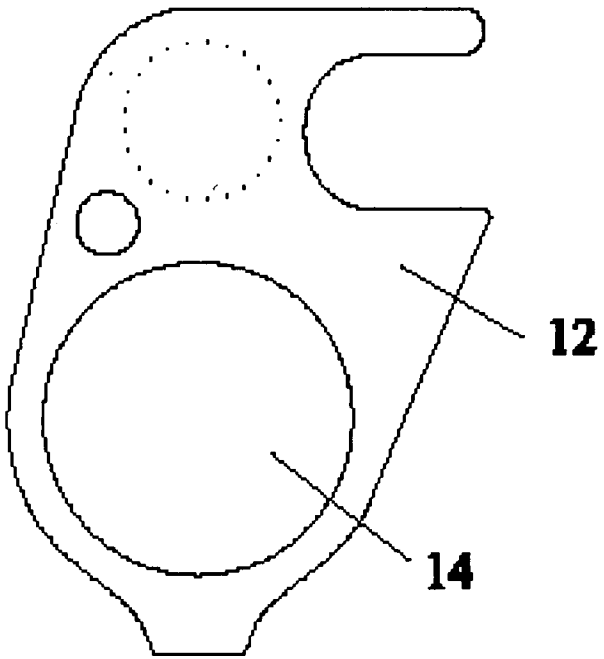
FIG. 2B shows a top view of the embodiment shown in FIG. 2A.
Figure 2A:
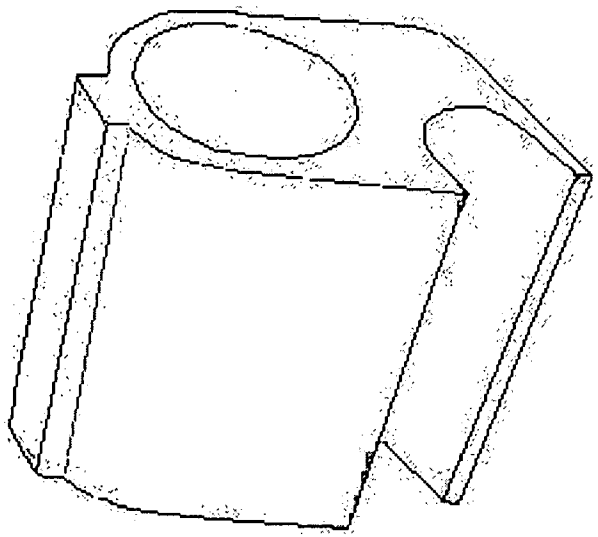
FIG. 2A shows a perspective view of an alternate embodiment of the present invention.
Figure 3B:
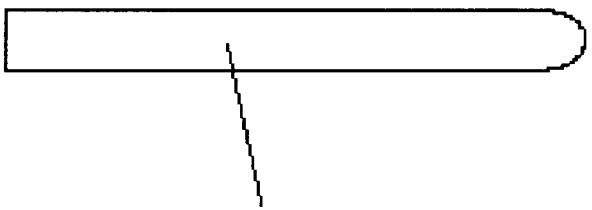
FIG. 3B shows a side view of the visual cue component detached from the device.
Figure 3A:
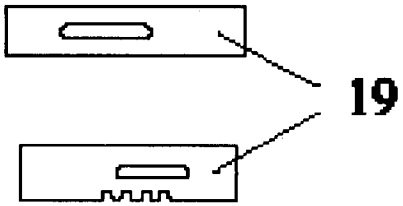
FIG. 3A and 3C show side views of the geared plunger (orig. spec. page 5 lines) and pivot gear. Apg 3 spec. a gear track and corresponding gear.
Figure 3C:
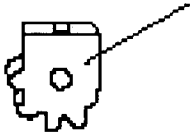
Figure 4B:
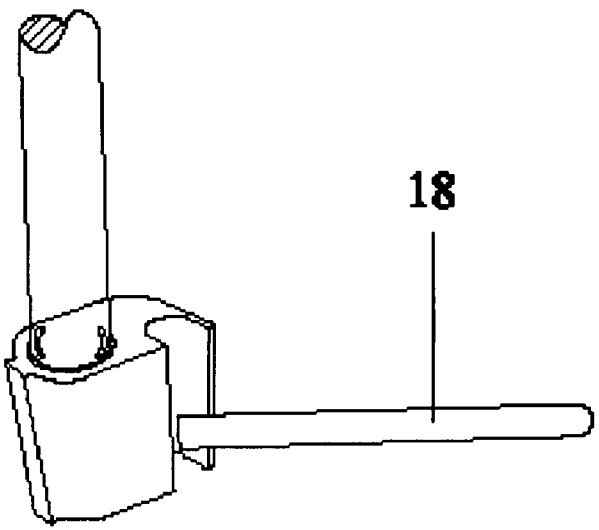
FIG. 4B illustrates a perspective view of the device shown in FIG. 4A, except the device is shown in a lowered or extended visual cue position.
Figure 4A:
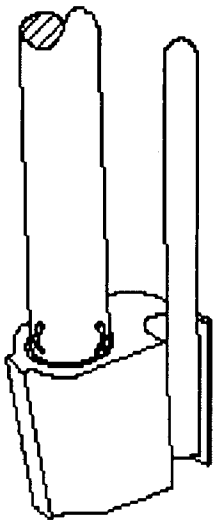
FIG. 4A illustrates a perspective view of the device according to the present invention in a raised position.

Referring now to the drawings in general, the illustrations are for the purpose of describing a preferred embodiment of the invention and are not intended to limit the invention thereto. As best seen in FIGS. 1A, 1B, 1C, a walking aid device according to the present invention, generally referenced 10, is shown. FIGS. 2A and 2B shows the walking aid device in perspective views, with an indication of where and how it is attached to a cane or walking support leg. FIG. 2A shows a perspective view of an alternate embodiment of the present invention. FIG. 2B shows a top view of the embodiment shown in FIG. 2A. FIGS. 3A and 3C show side views of the geared plunger 19 and pivot gear 20, or a gear track and corresponding gear. FIG. 3B shows a side view of the visual cue component 18 detached from the device. FIG. 3C shows a perspective view of the pivot gear 20 component detached from the device. FIG. 4A illustrates a perspective view of the device according to the present invention in a raised position. FIG. 4B illustrates a perspective view of the device shown in FIG. 4A, except the device is shown in a lowered or extended visual cue 18 position.

The present invention provides a walking aid device for assisting a user to walk by presenting a true 3-D obstacle that is automatically activated during normal use of a cane or walking support, to which the device is attached proximal to the floor end, and during use when in an extended position is non-parallel to the floor surface, is perceived by the user to be an obstacle over which the foot on the same side of the user's body must step. A method of use providing for attaching the device to the cane or walking support and using it in a cycle that produces a walking-type motion for the user. The body element 12 of a walking aid device of the present invention serves at least two independent functions. On an identification note, it is the most visible component and is capable of being marked, such as with a logo, personalization, and/or identification marking on at least one side. A second function of the body element is to serve as a rigid chassis that is the foundation, framework, and/or housing for the operational features of the device. The body further includes a plurality of different operational components that are important to the overall function, operation, and structure of the device. These components include: a cane attachment feature for attaching the walking aid device to a cane or other support structure that is portable but able to provide support for a person, wherein the cane is supplied by the user in one embodiment of the present invention; a geared plunger (19, 20 in FIG. 2); a pivot gear connected to a visual cue obstacle 18; and an interface providing an attachment point for optional lighting device. Preferably, the visual cue obstacle is substantially elongated and/or rod-shaped.

Preferably, the walking aid device is constructed with an opening 14 that is sized, shaped, and constructed to receive any cane or walking support leg therethrough. A parallel opening or hole is provided for the device. Furthermore, the walking aid device is constructed with a cavity between the parallel openings or holes so that the gears and plunger of the device can interact without interference. FIG. 1C illustrates spring element 45 of the device.

In one embodiment of the present invention, the walking aid device is preferably designed to be attached to a cane or other walking support, thereby permitting the user to select from and use his/her favorite cane, i.e., a cane having preferred dimensions, weight, color, identification markings, body style, and optional features, components, and/or functionality, within a reasonable range of sizes, which are sized to accommodate the range of adult human heights. The walking aid device is preferably releasably attachable to the cane or walking support, so that the user can alternate among a variety of cane or walking supports, to permit flexibility of style, function, occasion, fashion, identification, reflectivity, lighting, and the like. Alternatively, the walking aid device of the present invention may be integrally and unitarily connected or secured to the cane or walking aid device. To optimize or facilitate connectivity and functionality with the walking aid device of the present invention, it is beneficial for the cane or walking support to be adjusted or adapted including the following: removing any oversized feet or end cap or cover; providing a cane or leg shaft having a substantially symmetrical cross-section, more preferably, substantially circular with a diameter between about 0.5 and about 2.0 inches, more preferably between about 0.75 inches and about 1.2 inches, which accommodates most commercially available canes and walking support legs at the time of the invention.

Also, in one embodiment of the present invention, the cane fits or connects matingly with an alignment cavity of the walking aid device and is retained in place by pressure or compressive forces. Also, preferably, the device is releasably attachable with the cane or walking support in such a manner to permit its rotation about a longitudinal axis of the cane or support leg, to permit use of the walking aid device for either the right or left hand, and corresponding foot for the step-over action to facilitate walking by the user. The present invention is constructed and configured to ensure alignment of the cane handle or walking support handle, the plunger, the rod shaped obstacle, and the non-slip foot, which contacts the floor or support surface directly.

The walking aid device of the present invention is preferably releasably attachable or attached to a cane or walking support leg, wherein the releasable attachment includes a positive locking mechanism to ensure stability and safety during use by the user to aid his/her walking. The positive locking mechanism is selected from the group including a thumbscrew locking mechanism, a latching mechanism, a pressure and/or compressive force-based mechanism, and the like to hold in place the device with the cane or walking support leg.

When connected, it is preferably to position the device such that the visible cue portion, which is preferably substantially elongate or rod-shaped, or a rod, to be positioned proximal the end of the cane or walking support leg, and when activated to be in an extended position during use, between about 60 to about 100 degrees, more preferably about 90 degrees to the cane or walking support leg. While this substantially perpendicular positioning at extension is preferred, exceptions may apply to accommodate the individual needs of any user and his/her physical limitations and abilities, such as degree of affliction with Parkinson's disease, i.e., how severely affected the walking motion is.

More particularly, the walking aid device is preferably positioned and connected with respect to the cane or walking support leg such that, when the visual cue physical obstruction rod is activated or in an extended position, the remote end from the cane or walking support leg physically touches the floor, i.e., it taps the floor because the present invention walking aid device is never flat against the floor at any time during use by a user. This positioning provides surprising results inasmuch as the walking aid device visual cue physical obstruction rod provides a clear, distinct visual stimulation of its presence to the user. Avoiding paralleling and/or contacting the floor, since only the tip of the device touches upon extension with the floor, the present invention walking aid device produces a visual cue with clear, discrete 3-D distinction from the floor surface, regardless of lighting, color contrast, or size of the obstacle. Thus, a smaller diameter rod is operable with the walking aid device of the present invention, which permits a lighter weight device, clearly a benefit to users already encumbered with physical and/or muscular activation conditions, such as with Parkinson's disease.

Preferably the walking aid device of the present invention is formed from a semi-rigid or rigid material, and designed, constructed, and configured to ensure alignment of cane, the walking aid device, and the rod and plunger mechanism that provides the visual cue via presenting a physical obstacle over which the user must step to produce a regular walking-type forward motion.

The plunger device further includes a spring element, preferably having adjustable limits of motion and/or range of motion, thus providing adjustability to accommodate varying heights of users within the range of adult human beings. The plunger device also includes a gear track and corresponding gear, wherein the gear on the rod is provided and positioned to operate at a pivot point where the device raises and lowers allowing it to be in the lower position to extend the physical obstacle, such as the rod or rod-like elongated element, providing a distinct, 3-D visual effect when activated to be positioned in the extended position, and functions to raise the obstacle to move it out of the way, i.e., out of the substantially horizontal path of the user's foot motion along the floor or ground, to avoid tripping the user or catching on clothes, such as a pants leg. In a preferred embodiment, the gear track corresponding gear dimensions are between about 0.50 inches and about 1.25 inches, more preferably 0.75 inches, and travels about one inch. In any case, the walking aid device and its plunger-gear track-gear-obstacle components are designed, constructed and configured to be ground-impact activated, i.e., when the user provides or applies an activating weight to the cane or walking support, the applied weight activates the device to move the obstacle element into an extended position. Thus the device itself functions as the end of the cane, i.e., the weight-bearing ground end portion of the cane when the device is attached to a cane or leg of a walking support. Preferably, the device further includes an anti-skid ground surface, which may include a textured surface, a high friction material, a softer plastic or rubber, and the like, and combinations thereof. The anti-skid ground surface may further be included in an end cap element, which may be similar to a normal end cap for a cane.

The present invention walking aid device provides assistance to a user for stimulating a normal walking movement with his/her foot/leg by presenting what is perceived by the user's brain to be an obstacle or impediment to forward motion. However, by contrast to prior art, the present invention provides a true 3-D visual cue element, which is preferably an elongate, rod-shaped or rod element that is movable between a closed or collapsed position and an extended position. When in the extended position, the obstacle element is distinguishable from the floor or ground because it is not parallel to the surface, i.e., it is discrete and physically distanced from the floor in a non-parallel manner, since the remote tip or end of the element when in the extended position touches or taps the floor in approximately a point or limited length, while the remainder of the obstacle element extends upwardly, spaced apart from the floor. In the case of the visual cue element or obstacle element being a rod or rod-like element, the distance from the touch point on the floor or ground is gradually increasing to a maximum height or distance from the floor where the obstacle element connects to the cane or walking support leg. Thus, the walking aid device of the present invention, when connected with a cane and activated by an applied weight provided by a user, automatically produces a distinctly 3-D, elongate or rod-shaped obstacle to serve as a "visual cue" for the user that is readily and clearly distinguishable and separate from the floor, since it is not parallel to the floor and will not appear to be connected with or integral to the floor. Therefore, the visual, physical obstacle provided by the walking aid device of the present invention is a true 3-D component over which the user must step in order to move forward with a walking-like motion. When the rod or visual, physical obstacle is extended, it occupies a space non-parallel to the floor, i.e., it is a noticable distance above the plane of the floor from a first end attached to the cane to a second end that is touching or tapping the floor at its remote tip or end. The visual cue obstacle raises and lowers automatically as the cane is used in the normal fashion a cane is used, without presenting any additional action to be taken by the user when moving forward in a walking-type manner. Thus, the present invention uniquely provides a mass to stand out away from the floor as a distinct and readily-distinguishable 3-D obstacle that is not parallel to the floor, when the obstacle is extended to maximize the visual cue effect to the user. Therefore, the present invention provides a true 3-D visual obstacle that is nowhere taught or suggested in the prior art. In one embodiment of the present invention, the obstacle element is a rod having dimensions between about 0.25 and about 0.5 inches in diameter, and with a length between about 4 and about 8 inches long, preferably about 6 inches long.

The visual cue presented by the physical, true 3-D obstacle element of the walking aid device of present invention is preferably used as a primary visual cue to the user; however, the walking aid device may further include supplemental cues for the user to be used in combination with the primary visual cue. Additional, supplemental cues include a light, which may be an LED to illuminate the rod, a light beam projected along the rod, a light projected onto the floor immediately around the rod; the cue(s) may be plunger activated, as with the primary visual cue of the present invention, to make their use automatic with use on cane so no hand or other controls/activation required; the cue(s) may include a manually activatable between on/off status; sound cue(s), such as a tapping sound made by the rod tip or end on floor.

In another embodiment of the present invention, the walking aid device is provided as securely connected or integrally formed with the cane or walking support leg, whether as an attachable retrofit to an existing cane or walking support, or initially formed therewith.

The present invention also includes a method of using the walking aid device as set forth hereinabove. In such a method, providing the walking aid device, which is operable with a cane or walking support; connecting or attaching the walking aid device to the cane or walking support leg at a position proximal to the end nearest the floor, but separated by a minimum distance to ensure 3-D visability with the floor, i.e., to ensure that, when in an extended position, the obstacle element is non-parallel to the floor; to do this, the user's cane or walking support leg is inserted into the cane alignment cavity of the device; the cane or walking support leg is secured by pressure or compressive force from a positive securement component such as a thumbscrew; rotating the device to be secured such that the obstacle element or rod extends in the walking path of the user when the cane or walking support leg is in normal use by the user, meaning that if the user is right handed, the device is rotated 180 degrees from the position a left handed person would use; removing an obstacle element status pin from the side of the device and placing it in a compartment or holder at or near the top of the device; using the device to walk wherein normal use of the cane or walking support automatically extends and retracts the physical obstacle during a normal walking-type movement.

The method of use for a right handed person includes the steps of the user using the cane in the normal manner, wherein the cane is placed on the floor in front of the user in the direction they intend to walk; the user providing or applying a pressure or weight force to the cane or walking support; when the device is in contact with the floor and normal hand pressure is allowed, the rod shaped obstacle is automatically extended or lowered into position to serve as a "visual cue" obstacle over which the user must step in order to proceed in a forward walking-type motion.

Whether in a "freezing" condition or needing a walking stimulation, the rod-shaped obstacle will provide the true 3-D "visual cue" for the person to take their next step in a cycle wherein the user takes a step over the obstacle in the extended position and moves the opposite foot forward in a sliding-type motion instead of stepping in as pronounced a manner as with the first foot. The user steps over the rod-shaped obstacle starting with the foot on the same side in which they are holding the cane (in this first scenario, that would be the right foot).

As the user moves his/her body forward and weight goes to the right foot, the left foot and leg should follow whether in a stepping, sliding, or dragging manner.

As the weight is shifted onto the left foot, the cane is brought forward and repositioned in the normal cane utilization method slightly in front of the user's fight foot. As the cane or walking support leg is being lifted from the floor and brought forward as described in this step, the rod-shaped obstacle automatically retracts to allow the can to move forward without interfering with the leg, foot, or the clothes of the user.

The process starts over and is repeated in a cycle, wherein a first foot steps over the visual cue obstacle provided by the walking aid device of the present invention, a second foot slides forward, and the cane or walking support is repositioned (one move forward) as the user takes the next step, repeating the cycle. When using the walking aid device of the present invention, every series of right and left foot steps must start with the foot on the same side as the cane, i.e, the forward motion of the user starts every cycle with the user stepping over the walking aid device obstacle, when it is in the extended position in front of the user's foot. The plane of the body is broken by the cane and the right foot of the user; however the left foot is merely brought forward in a sliding or shifting motion (not being raised in a stepping motion as with the first foot in the cycle) and stops at that plane. The walking may be described as taking one full step with the right foot and a half step with the left (or vice versa) for a full cycle. If the user is left handed, the right and left references in the foregoing cycle steps are reversed.

Certain modifications and improvements will occur to those skilled in the art upon a reading of the foregoing description. All modifications and improvements have been deleted herein for the sake of conciseness and readability but are properly within the scope of the following claims.

What is claimed is:

1. A walking aid device comprising:

a body element attachable to a walking support;

a plunger device;

a visual cue component that provides a physical barrier when in an extended position, and that stands out away from a floor surface when extended to maximize the distinction from the surface;

translation means for moving the visual cue component between a first position and a second position that is extended from the body element;

wherein the translation means are disposed within the body and connected with the plunger device and the visual cue component such that the visual cue component is automatically moved between the first and second positions when a user applies weight to the walking support when the device is attached thereto and activates the plunger device against the floor surface;

wherein the body element includes a first opening that is constructed to receive a cane therethrough, a second opening that is substantially parallel to the first opening, and a cavity between the first and second opening that permits the translation means to operate;

thereby providing a physical obstacle over which the user must step to move forward in a walking-type motion.

2. The device of claim 1, wherein the opening has a diameter between about 0.5 and about 2 inches.

3. The device of claim 2, wherein the opening has a diameter between about 0.75 and about 1.2 inches.

4. The device of claim 1, wherein the translation means is provided by a gear, a gear track, and a plunger that interact.

5. The device of claim 1, wherein the body element is releasably securable to the walking support.

6. The device of claim 1, wherein the device is secured to the walking support by a positive locking mechanism that uses a pressure or compressive force to hold the device securely in position when secured to the walking support.

7. The device of claim 1, wherein the device is secured to the walking support proximal to the floor surface when in use, such that when weight is applied to the walking support by the user, the visual cue component is activated to an extended position wherein a remote end of the visual cue component taps the floor surface.

8. The device of claim 1, wherein the body element and the visual cue component are each formed from a rigid material.

9. The device of claim 1, wherein the translation means provides for adjustable range of motion.

10. The device of claim 1, wherein the translation means provides a pivot point at which the visual cue component is operable to be moved between a closed, inactivated position and an activated, extended position for providing the visual cue.

11. The device of claim 1, wherein the activation of the visual cue component is ground impact activated during normal use of the walking support when the device is secured thereto.

12. The device of claim 1, further including an anti-skid ground surface on a bottom end that contacts the ground surface during normal use of the walking support when the device is secured thereto.

13. The device of claim 1, wherein the visual cue component is a rod.

14. The device of claim 1, wherein the visual cue component further includes at least one supplemental cue(s).

15. The device of claim 14, wherein the supplemental cues include light, sound, and/or additional visual cues.

16. A method of using the device of claim 1, comprising the steps of:

Providing the device securedly attached to a walking support for use to aid walking by an adult person user;

the user applying a weight to the walking support device;

the device automatically activating the visual cue element to move into an extended position, wherein the user must step over the visual cue component created thereby;

the user stepping over the visual cue component created by the extended visual cue component;

the user releasing the applied weight;

the visual cue component automatically returning to the inactivated position, wherein the visual cue component is retracted;

repeating the foregoing steps in series.

17. A walking aid device comprising:

a body element securely attached to a walking support;

a plunger device;

a visual cue component that provides a physical barrier when in an extended position, and that stands out away from a floor surface when extended to maximize the distinction from the surface;

translation means for moving the visual cue component between a first position and a second position that is extended from the body element;

wherein the translation means are disposed within the body and connected with the plunger device and the visual cue component such that the visual cue component is automatically moved between the first and second positions when a user applies weight to the walking support when the device is attached thereto and activates the plunger device against the floor surface;

and wherein the body element includes a first opening that is constructed to receive a cane therethrough, a second opening that is substantially parallel to the first opening, and a cavity between the first and second opening that permits the translation means to operate;

thereby providing a physical obstacle over which the user must step to move forward in a walking-type motion.

* * * * *